US006979228B2

(12) United States Patent
Zhang

(10) Patent No.: US 6,979,228 B2
(45) Date of Patent: Dec. 27, 2005

(54) ELECTRICAL CONNECTOR HAVING CONTACT WITH HIGH CONTACT NORMAL FORCE AND SUFFICIENT RESILIENCY

(75) Inventor: Chi Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/937,935

(22) Filed: Sep. 9, 2004

(65) Prior Publication Data

US 2005/0042899 A1 Feb. 24, 2005

(30) Foreign Application Priority Data

Sep. 9, 2003 (CN) ..... 03278517 U

(51) Int. Cl.[7] ..... H01R 33/00
(52) U.S. Cl. ..... 439/660; 439/74
(58) Field of Search ..... 439/660, 74, 637, 439/676

(56) References Cited

U.S. PATENT DOCUMENTS 5,137,454 A * 8/1992 Baechtle ..... 439/62
5,797,770 A 8/1998 Davis et al.
5,836,773 A * 11/1998 McHugh et al. ..... 439/74
6,033,236 A 3/2000 McHugh et al.
6,206,706 B1 * 3/2001 Lee et al. ..... 439/74
6,210,177 B1 * 4/2001 Huang et al. ..... 439/74
6,213,804 B1 * 4/2001 Matsumura ..... 439/267

* cited by examiner

*Primary Examiner*—J. F. Duverne
(74) *Attorney, Agent, or Firm*—Wei Te Chung

(57) ABSTRACT

An electrical connector includes a dielectric housing and a terminal. The dielectric housing includes a mating surface, a mating space in the mating surface, a passageway communicating with the mating space and having an inner face, and a stopper extending into the passageway. The terminal is received in the passageway and comprises an intermediate beam having a fulcrum contacting with the inner face of the passageway and a spring arm extending curvedly from the intermediate beam. The spring arm has a contact portion extending into the mating space and a tab abutting against the stopper for being pre-stressed. The intermediate beam and the inner face of the passageway define an elongated slit therebetween. The spring arm and the inner face of the passageway define a resilient room therebetween communicating with the elongated slit. The contact portion is movable toward the inner face of the passageway to cause the fulcrum moving toward the spring arm.

6 Claims, 4 Drawing Sheets

ELECTRICAL CONNECTOR HAVING CONTACT WITH HIGH CONTACT NORMAL FORCE AND SUFFICIENT RESILIENCY

BACKGROUND OF THE INVENTION

1. Field of the Invention

The present invention relates to an electrical connector, and more particularly to board-to-board having a plurality of terminals with high contact normal force and sufficient resiliency.

2. Description of Related Art

Board-to-Board connector assembly generally includes a plug and a receptacle connectors respectively mounted on two parallelly spaced printed circuit boards (PCB) and mated with each other for mechanical and electrical interconnection therebetween, whereby the corresponding printed circuit boards can be electrically connected with each other for signal transmission.

The plug and the receptacle respectively comprise a plurality of terminals to establish an electrical and mechanical connection therebetween. It is well know that a high enough mating force is required between the terminals of the plug and the terminals of the receptacle for ensuring reliable signal transmission between the plug and receptacle. In order to increase the mating force, the receptacle generally provides an enough space for sufficient elastic deflection of the terminals. This conflicts with the continuing trend of the connector toward miniaturization. U.S. Pat. No. 5,797,770 discloses another solution to improve mating force of a receptacle by providing a plurality of pre-stress terminals. However, repeated engagement between the plug and the receptacle may wear out the terminals of the receptacle due to the pre-stress terminals having high mating force.

Hence, a receptacle connector with improved contacts is desired to overcome the disadvantage of the prior art.

SUMMARY OF THE INVENTION

An object of the present invention is to provide an electrical connector with a plurality of improved terminals with high contact normal force for ensuring a reliable connection with a complementary connector.

To achieve the above object, an electrical connector includes a dielectric housing and a terminal. The dielectric housing includes a mating surface, a mating space in the mating surface, a passageway communicating with the mating space and having an inner face, and a stopper extending into the passageway. The terminal is received in the passageway and comprises an intermediate beam having a fulcrum contacting with the inner face of the passageway and a spring arm extending curvedly from the intermediate beam. The spring arm has a contact portion extending into the mating space and a tab abutting against the stopper for being pre-stressed. The intermediate beam and the inner face of the passageway define an elongated slit therebetween from the fulcrum. The spring arm and the inner face of the passageway define a resilient room therebetween communicating with the elongated slit. The contact portion is movable toward the inner face of the passageway to cause the fulcrum moving toward the spring arm.

Other objects, advantages and novel features of the invention will become more apparent from the following detailed description when taken in conjunction with the accompanying drawings.

DETAILED DESCRIPTION OF THE PREFERRED EMBODIMENT

Figure 1:
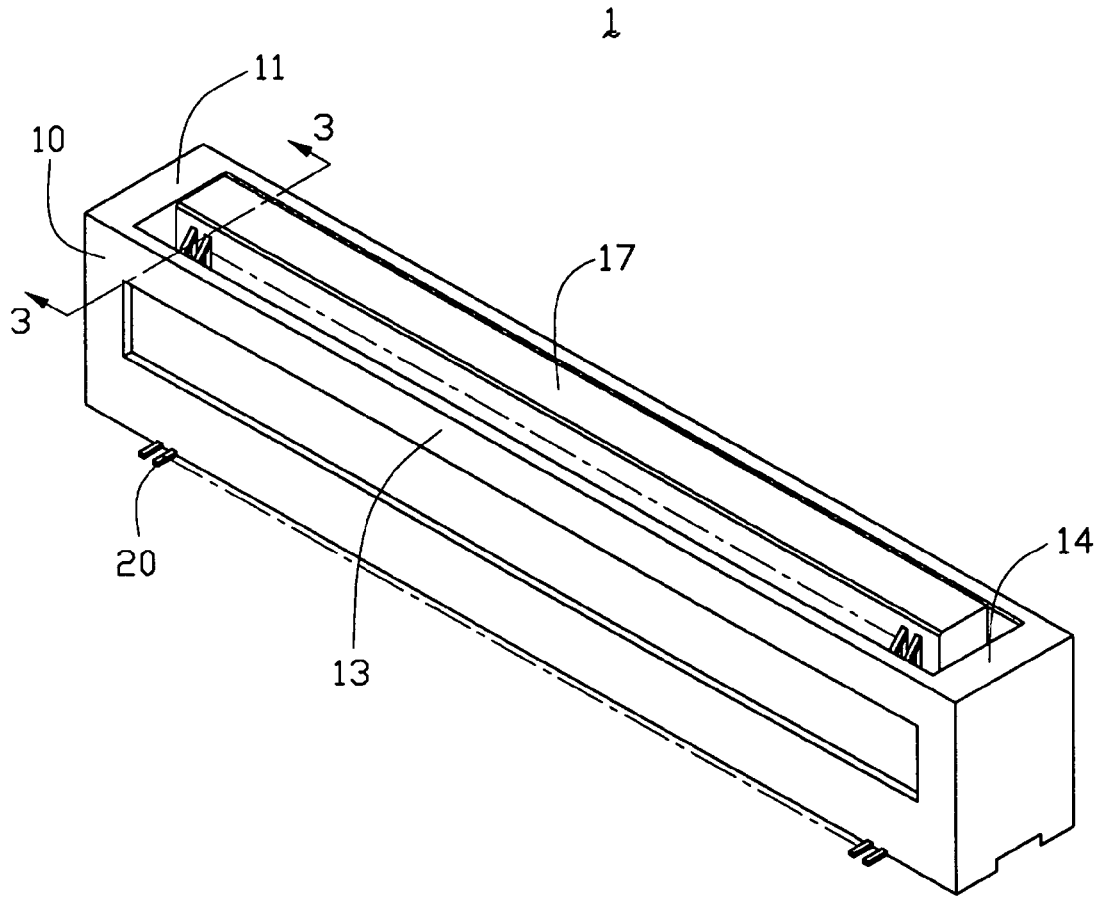
FIG. 1 is an assembled perspective view of an electrical connector in accordance with the present invention.
Figure 4:
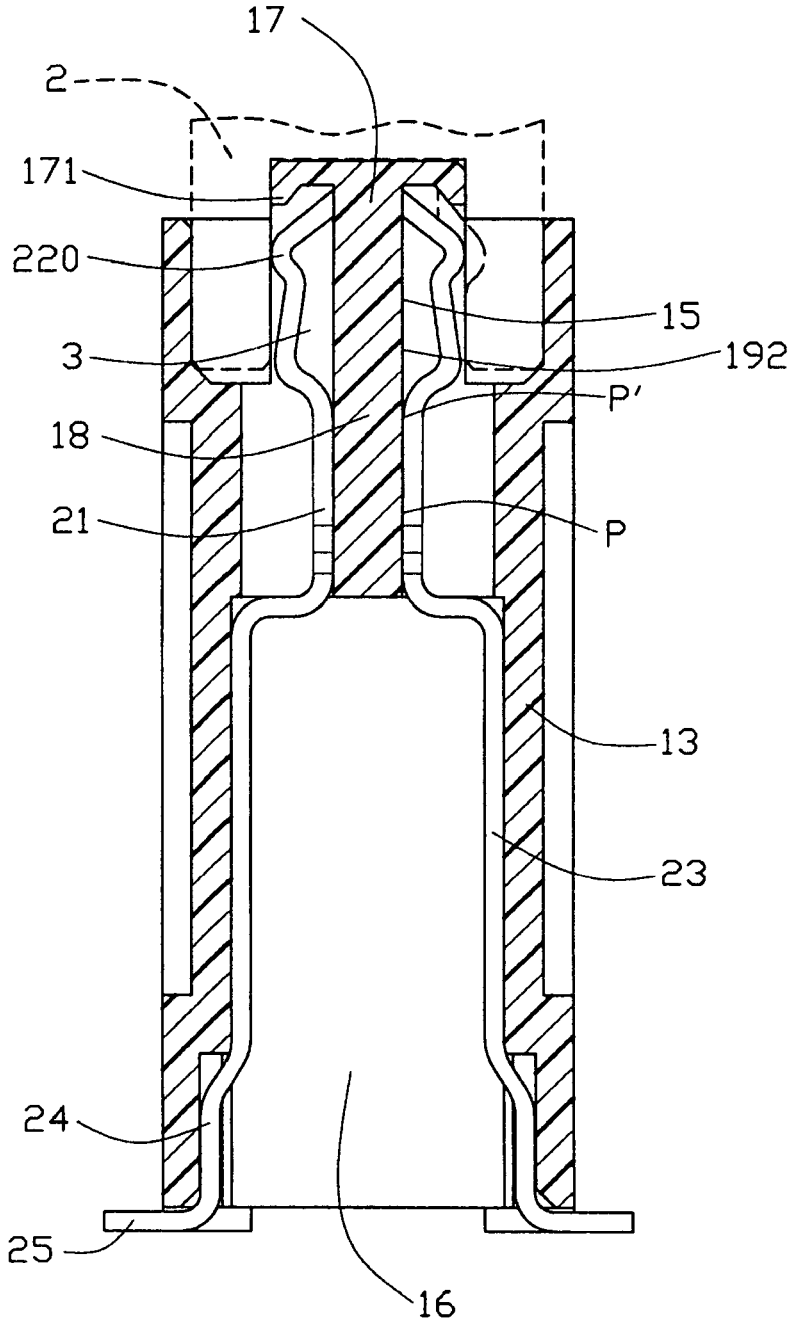
FIG. 4 is a view similar to FIG. 4, but showing a state of the electrical connector after engaging with a complementary connector.

Referring to FIGS. 1 and 4, an electrical connector 1 in accordance with the present invention for engaging with a complementary connector 2 comprises an elongate dielectric housing 10 and a plurality of terminals 20 received in the dielectric housing 10.

Figure 2:
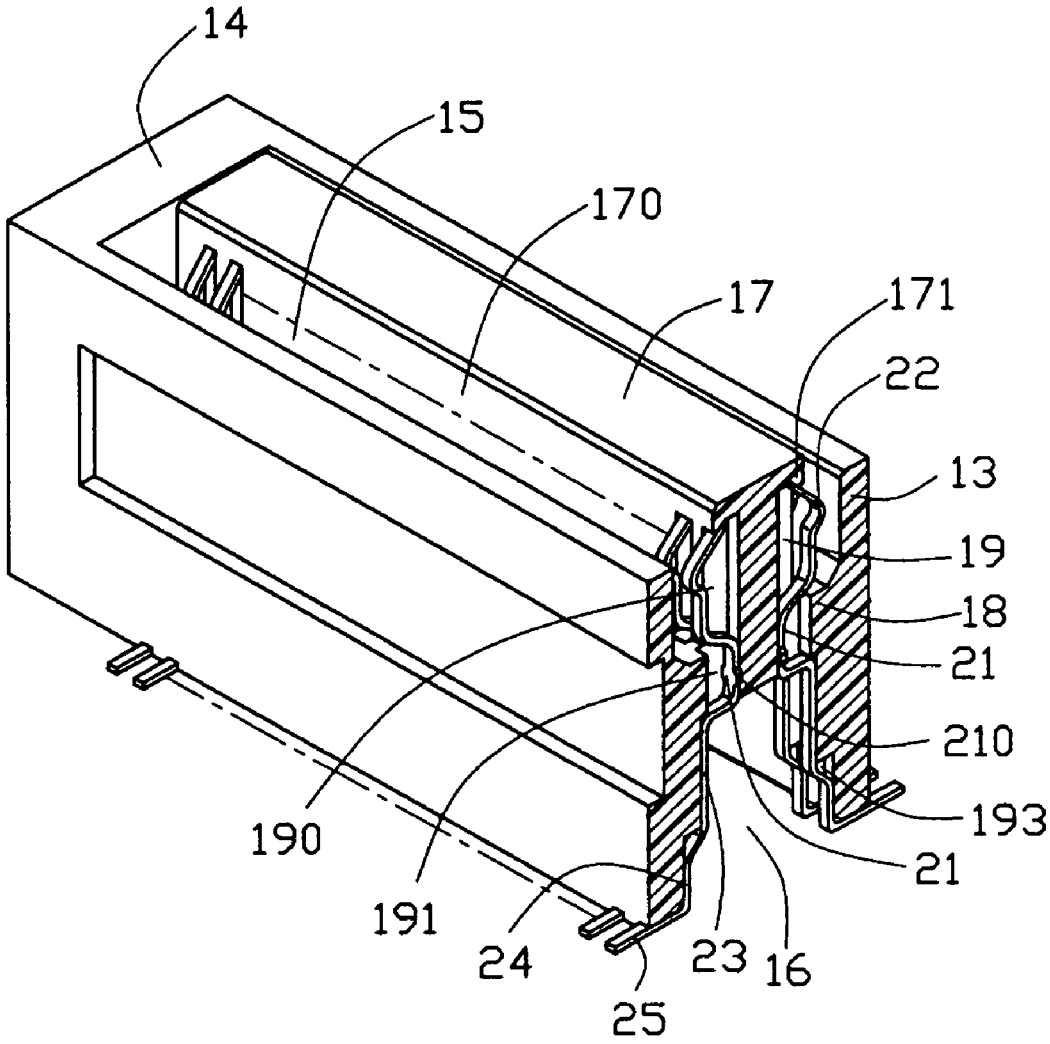
FIG. 2 is an enlarged fragmentary perspective, cross-sectional view of the electrical connector shown in FIG. 1.
Figure 3:
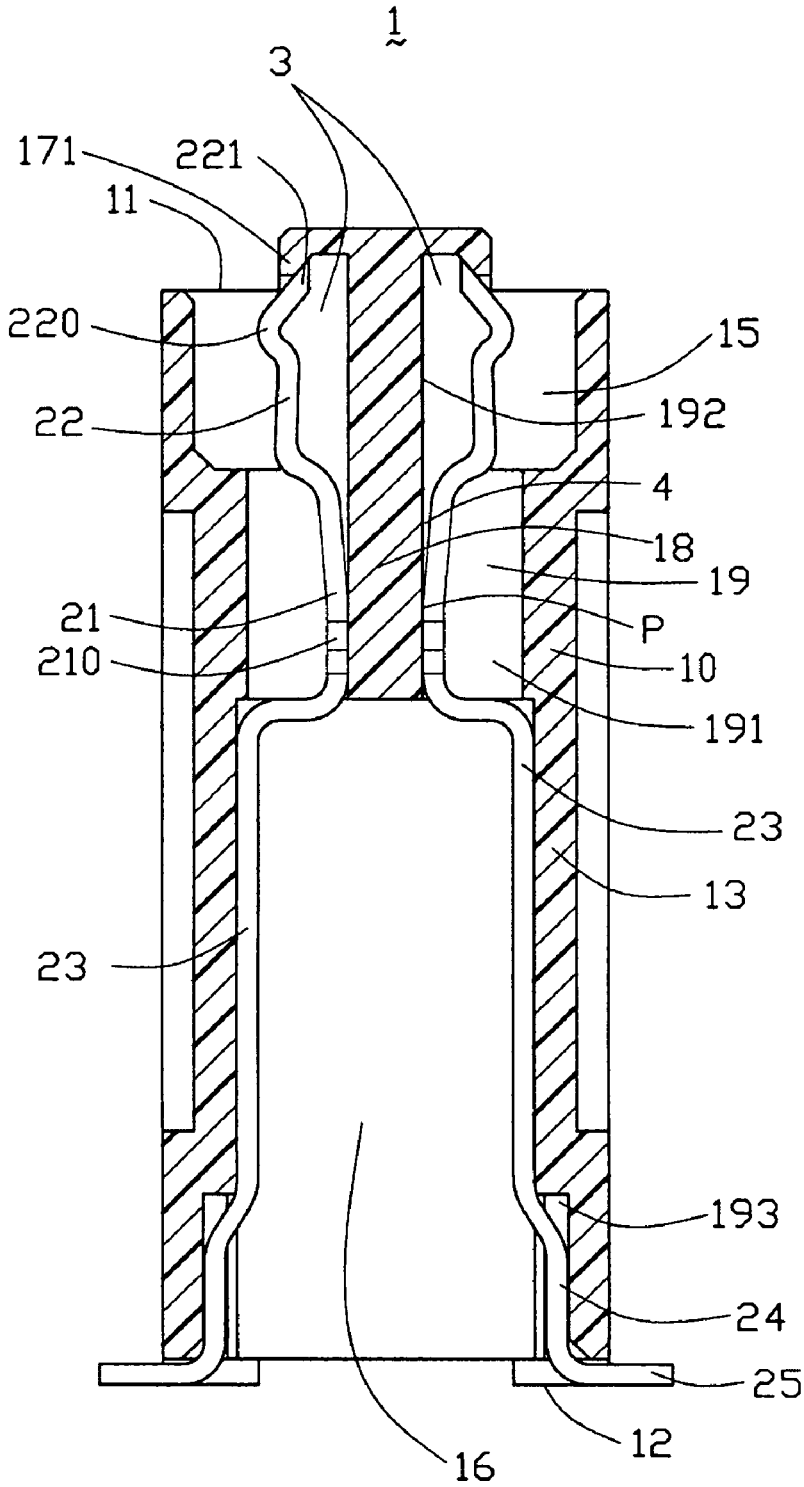
FIG. 3 is a cross-sectional view of the electrical connector taken along line 3—3 of FIG. 1.

Referring to FIGS. 2 and 3, the dielectric housing 10 has a mating surface 11 and a mounting surface 12 opposite to the mating surface 11. Laterally spaced opposite side walls 13 and longitudinally spaced opposite end walls 14 extend between the mating surface 11 and the mounting surface 12, respectively. The dielectric housing 10 comprises a mating space 15 in the mating surface 11 between the side walls 13, a cavity 16 in the mounting surface 12 between the side walls 13, and a clapboard 18 formed between the mating space 15 and the cavity 16 and interconnecting with the side walls 13 and the end walls 14. The dielectric housing 10 is formed with a mating portion 17 extending beyond the mating surface 11 from the clapboard 18 and located in the mating space 15.

As best shown in FIG. 2, the dielectric housing 10 defines a plurality of passageways 19. Each passageway 19 comprises a recess 190 defined in a side face 170 of the mating portion 17 and communicating with the mating space 15, a channel 191 extending downwardly from the recess 190 and passing through the clapboard 18 and an inner face 192 facing the recess 190 and the channel 191. The mating portion 17 is formed with a plurality of stoppers 171 extending into corresponding recesses 190, respectively. Each passageway 19 further comprises a cutout 193 defined in an inner face of the side wall 13 and adjacent the mounting surface 12.

Referring to FIGS. 3 and 4, the terminals 20 is received in corresponding passageways 19 of the housing 10 and each comprise an intermediate beam 21, a spring arm 22 extending curvedly and upwardly from one end of the intermediate beam 21, a connecting beam 23 extending downwardly from the other end of the intermediate beam 21 and a retaining leg 24 extending downwardly from the connecting beam 23. The intermediate beam 21 is formed with a pair of barbs 210 adjacent to the connecting beam 23. The spring arm 22 comprises a curved contact portion 220 and a tab 221 at a free end thereof. The terminal 20 further comprises a solder tail 25 perpendicularly extending from the retaining leg 24 for being surface mounting onto a printed circuit board (not shown).

Referring to FIGS. 3 and 4, the terminals 20 are inserted into the dielectric housing 10 from the mounting face 12. The intermediate beams 21 are retained in the channels 191 with the barbs 210 interferentially engaging with the dielectric housing 10 for securing the terminals 20 to the housing 10. The spring arms 22 are movably received in the recesses 190 with the tabs 221 abutting against the stoppers 171 of the mating portion 17 for pre-stressing the terminals 20 to increase a mating force between the terminal 20 of the electrical connector 1 and a corresponding terminal of the complementary connector 2. The contact portions 220 of the spring arms 22 extend into the mating space 15. The connecting beams 23 are attached to the inner faces of the side walls 13 and the retaining legs 24 are retained in the cutouts 24 for further securing the terminals 20 to the dielectric housing 10.

A room 3 is defined between the spring portion 22 and the inner face 192 of the passageway 19 for the spring arm 22 to deflect. The intermediate beam 21 has a first fulcrum P located above the barbs 210 and contacting with the inner face 192 of the passageway 19. An elongated slit 4 is defined between the intermediate beam 21 and the inner face 192 of the passageway 19 and communicates with the room 3. A distance between the first fulcrum P and the contact portion 220 is larger than that of a conventional connector. Thus, the spring portion 22 of the terminal has a better elasticity and is not easy to be wore out during repeated engagement with the complementary connector 2.

Referring to FIG. 4, when the electrical connector 1 in accordance with the present invention engages with the complementary connector 2, a mating portion of the complementary connector 2 is received in the mating space 15. The contact portion 220 is pressed to deflect the spring arm 22 toward the inner face 192 of the passageway 19, a second fulcrum P' of the intermediate beam 21 is accordingly formed and located above the first fulcrum P. A distance between the contact portion 220 and the second fulcrum P' is equal to or smaller than that of the convention connector, whereby the spring arm 22 having an enough high elastic coefficient. Therefore, the electrical connector has a mating force high enough to ensure a reliable connection with the complementary connector. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a mating surface, a mating space in the mating surface, a passageway communicating with the mating space and having an inner face, and a stopper extending into the passageway;

a terminal received in the passageway and comprising an intermediate beam having a fulcrum contacting with the inner face of the passageway and a spring arm extending curvedly from the intermediate beam, the spring arm having a contact portion extending into the mating space and a tab abutting against the stopper for being pre-stressed, the intermediate beam and the inner face of the passageway defining an elongated slit therebetween, the spring arm and the inner face of the passageway defining a room therebetween communicating with the elongated slit, the contact portion being movable toward the inner face of the passageway to cause the fulcrum moving toward the spring arm.

2. The electrical connector as claimed in claim 1, wherein the dielectric housing comprises a mating portion extending beyond the mating surface and located in the mating space, and wherein the passageway is defined on the mating portion.

3. The electrical connector as claimed in claim 1, wherein the intermediate beam is formed with a barb interferentially engaging with the dielectric housing.

4. The electrical connector as claimed in claim 1, wherein the terminal further comprises a connecting beam extending from the intermediate beam, a retaining leg extending from the intermediate beam and a solder tail extending from the retaining leg for being surface mounted onto a printed circuit board.

5. An electrical connector comprising:

an insulative housing defining a plurality of passageways, each of said passageways defining an innermost face and an outermost stopper;

a plurality of contacts received in the corresponding passageways, respectively, each of said contacts defining a retention portion abutting against the inner face, a tip abutting against the stopper in an un-mating condition of the connector so as to have the contact in a preloaded manner, a spring arm and an intermediate portion connected to said retention portion and said tip, respectively, and further connected to each other; wherein a first fulcrum is located between the retention portion and the intermediate portion for functioning in the un-mating condition of the connector, and a second fulcrum is located between the intermediate portion and the spring arm for functioning in a mating condition of the connector.

6. The electrical connector as claimed in claim 5, wherein said intermediate portion is slightly spaced from the inner face in said un-mating condition while abutting against the inner face in said mating condition.

* * * * *